US006257712B1

(12) United States Patent
Haigo

(10) Patent No.: US 6,257,712 B1
(45) Date of Patent: Jul. 10, 2001

(54) INK FEEDER

(75) Inventor: Hideaki Haigo, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/192,405

(22) Filed: Nov. 16, 1998

(30) Foreign Application Priority Data

Nov. 14, 1997 (JP) ..... 9-313426
Nov. 14, 1997 (JP) ..... 9-313428
Sep. 11, 1998 (JP) ..... 10-257987

(51) Int. Cl.[7] ..... B41J 2/175
(52) U.S. Cl. ..... 347/85; 347/86
(58) Field of Search ..... 347/7, 30, 85, 347/86, 87

(56) References Cited

U.S. PATENT DOCUMENTS 4,677,448 * 6/1987 Mizusawa et al. ..... 347/85
5,138,332 * 8/1992 Carlotta ..... 347/92
5,619,238 * 4/1997 Higuma et al. ..... 347/86
5,775,164 * 7/1998 Kishi ..... 73/304 R

FOREIGN PATENT DOCUMENTS

B2-63-44064 9/1988 (JP) .

* cited by examiner

*Primary Examiner*—N. Le
*Assistant Examiner*—Anh T. N. Vo
(74) *Attorney, Agent, or Firm*—Oliff & Berridge, PLC

(57) ABSTRACT

The invention includes an ink feeder in which bubbles are securely separated from ink, ink promptly flows in each ink chamber and ink hardly including bubbles is smoothly supplied to a print head. Partition walls that form multiple ink chambers by partitioning a casing are provided with upper communicating parts which allow the movement of air in each upper part of the ink chambers, and lower communicating holes which allow the movement of ink in each lower part of the ink chambers. An ink supply port, the lower communicating holes of the partition walls and an ink outlet are arranged so that they are not aligned, and disposed so that ink meanders in the ink subtank. An air communicating hole and an ink sensor that detects the quantity of ink are provided in one ink chamber of the multiple ink chambers. An ink outlet that ejects ink to the print head is further formed in the ink chamber. It is detected whether or not ink is required to be supplied from the main ink tank to the ink subtank by detecting the quantity of ink in the ink chamber by the ink sensor. Even if an ink film is formed in the upper communicating parts and the other ink chambers each become a closed space, a state in which the ink chamber communicates with the air is secured and the quantity of ink can be detected without difficulty.

25 Claims, 9 Drawing Sheets

INK FEEDER

BACKGROUND OF THE INVENTION

1. Field of the Invention

The invention relates to an ink feeder for supplying ink from a main ink tank to an ink subtank via an ink supply port, and supplying ink from the ink subtank to a print head via an ink outlet in an ink-jet printer or other device.

2. Description of the Related Art

A conventional ink feeder for supplying ink from a main ink tank to an ink subtank via an ink supply port, and supplying ink from the ink subtank to a print head via an ink outlet, is disclosed in Japanese Published Examined Patent Application No. Sho 63-44064.

As shown in FIGS. 9 and 10, the ink subtank of a conventional ink feeder is provided to supply ink, that is supplied from a main tank 208 via a tube 209 and an ink inlet 206A of a capillary tube 206, to a print head via an ink outlet 207A of a capillary tube 207 under a predetermined pressure. The interior of a casing 201 of the ink subtank stores ink, and is partitioned into multiple ink chambers A1 and A2 by a partition wall 203. The partition wall 203 has an upper communicating part 204 which allows the movement of air in its upper part, and a lower communicating hole 205 provided with resistant action which allows the movement of ink in its lower part. In the ink feeder disclosed in the above patent application, the ink subtank is filled with a large quantity of ink due to the partition wall 203 and the resistant action of the lower communicating hole 205. As shown in FIG. 10, the ink inlet 206A, the lower communicating hole 205 and the ink output 207A are approximately aligned.

In this type of ink feeder, to maintain printing quality, air, that is, a bubble in the ink, is separated in the ink subtank to prevent the bubble from flowing on the side of the print head, and the pressure of ink which acts upon the print head is set to a predetermined value based upon the positional relationship between the level of ink in the ink subtank and the print head.

However, a bubble may not be separated from the ink and may enter the print head, depending upon the position and the size of the lower communicating hole of the partition wall. However, the ink feeder that is provided with the lower communicating hole provided with resistant action and disclosed in the above patent application is subject to various problems. Specifically, it takes too long to fill the ink subtank with ink, the start of printing is delayed until the level of each ink chamber is equal, the level of each ink chamber becomes uneven, the supplement of ink is delayed and the pressure of ink which acts upon the print head is off a set value as ink is consumed, and printing quality is often deteriorated.

As shown in FIG. 8, for example, an ink subtank 101 previously devised by the inventors of the present invention is provided with a casing 102 that has an upper opening for storing ink and a cover 103 for closing the upper opening of the casing 102. The interior of the casing 102 is partitioned into first to third ink chambers 110, 111 and 112 by partition walls 108 and 109, that are respectively provided with upper communicating parts 104 and 105 which allow the movement of air in its upper part, and lower communicating holes 106 and 107 which allow the movement of ink in its lower part. Air is separated from the ink by making ink, that is supplied from an ink supply port 101A, meander in each ink chamber 110 to 112 in the ink subtank 101, so that only ink is moved to the print head via an ink outlet 101B.

An ink sensor 113, for detecting the quantity of ink, is provided at the first ink chamber 110. An air communicating hole 114, which exposes the third ink chamber to the air, is provided at a portion of the cover 103 that is opposite to the third ink chamber 112. When the ink sensor 113 detects that ink in the ink subtank 101 is decreasing as ink is jetted from the print head, a delivery device, such as a pump, is driven and ink is supplied from a main ink tank (not shown).

Since, in this type of ink subtank, ink supplied from the main ink tank is supplied to the print head under predetermined pressure, the positional relationship between the level of ink in the ink subtank and the print head effects the pressure in the print head and printing quality.

In the ink subtank 101 that has multiple ink chambers 110 to 112, when the ink subtank is carried, or an impact is applied to it, the level of ink in each ink chamber fluctuates. Ink may thus pass the upper communicating parts 104 and 105, and an ink film may be formed in the upper communicating parts 104 and 105 by the surface tension of ink when the ink passes. When the ink film is formed in the upper communicating parts 104 and 105 as described above, the ink chambers 110 and 111 each become a closed space. Since the level in the ink chamber 110 is unchanged independent of the state of ink in another ink chamber, if the ink chamber 110 that is provided with the ink sensor 113 becomes a closed space, for example, the ink sensor 113 is kept in either an on or off state.

If the ink sensor 113 is off, it is judged that there is not much ink, the pump is driven, and ink is supplied to the first ink chamber 110 via the ink supply port 101A. However, since the ink chamber 110 is a closed space and the level of ink is hardly changed, the supply of ink from the main ink tank is continued. As a result, ink flows into the second and third ink chambers 111 and 112, respectively, via the lower communicating holes 106 and 107, ink is excessively supplied, each level of the second and third ink chambers 111 and 112 rises, and ink may overflow to the exterior via the air communicating hole 114.

In the meantime, if the ink sensor 113 is on, it is judged that ink remains in the ink chamber, and ink is not supplied to the first ink chamber 110. However, since the first ink chamber 110 is a closed space, the level of ink is hardly changed even if ink is consumed because of the supply of ink to the print head and ink continues to not be supplied. As a result, ink is not supplied, only ink in the second and third ink chambers 111 and 112 continues to be consumed. Finally, the amount of ink in both ink chambers 111 and 112 becomes low, and it may occur that ink cannot be supplied to the print head and the amount of ink may become low. Even if no extreme state occurs, the level of each ink chamber cannot be controlled, pressure in the print head is changed and such a state has an effect upon printing quality.

SUMMARY OF THE INVENTION

The invention is provided to solve the above problems, and its object is to provide an ink feeder for securely separating a bubble from ink, enabling ink to promptly flow into each ink chamber and the smooth supply of ink that hardly includes a bubble to the print head. Another object is to provide an ink feeder, wherein ink can be securely supplied without ink overflowing due to the excessive supply of ink or without the amount of ink becoming low.

The invention is embodied in the following embodiments and the following effect is produced.

In an ink feeder according to the invention for supplying ink from a main ink tank to an ink subtank via an ink supply port, and supplying ink from the ink subtank to a print head via an ink outlet, the ink subtank includes a casing that stores ink, and at least one partition wall that partitions the casing and forms multiple ink chambers. The at least one partition wall has an upper communicating part which allows the movement of air in an upper part of the ink chambers, and a lower communicating hole which allows the movement of ink in a lower part of the ink chambers. The ink supply port, the lower communicating hole of the at least one partition wall and the ink outlet are disposed so as not to be aligned, and the ink subtank is formed so that ink meanders.

According to the invention, ink meanders from the ink supply port to the ink outlet via the lower communicating hole in the ink subtank, and bubbles in the ink are moved upward because of buoyancy and separated while the ink meanders. As a result, bubbles are prevented from flowing into the print head, and the print continues to satisfactorily jet ink.

Also, in the invention, the ink supply port and the ink outlet are open at the bottom of the ink subtank. According to the invention, ink flows along the bottom of the ink subtank from the ink supply port to the ink outlet via the lower communicating hole, bubbles are moved upward by buoyancy and are satisfactorily separated.

Also, in the invention, the ink supply port and the ink outlet are adjacently located in the corners of the bottom of the ink subtank, and the lower communicating hole of the at least one partition wall is adjacently located on the side of the ink subtank on the reverse side to the corners of the bottom. According to the invention, ink flows along the bottom of the subtank with ink reciprocating approximately at a maximum, and bubbles are more satisfactorily separated.

Also, in the invention, multiple partition walls can be provided between the ink supply port and the ink outlet. The lower communicating holes of adjacent partition walls of the multiple partition walls are respectively located close to the opposite sides of the ink subtank. According to the invention, the flow of ink is more extended, and bubbles are further satisfactorily separated.

Also, in the invention, the width (C) of the lower communicating hole of the at least one partition wall is approximately 3 to 8 mm, and the length (E) from the center of the lower communicating hole to the ink supply port or the ink outlet is equivalent to approximately 50% or more of the whole length (F) of the tank. According to the invention, when ink meanders, a large quantity of bubbles never pass the lower communicating hole together with the ink, bubbles are more securely separated, the lower communicating hole never interrupts the flow of ink, no ink film is formed in the lower communicating hole when ink is initially filled, the level of each ink chamber promptly becomes even and ink is smoothly supplied to the print head under a set pressure.

Also, in the invention, the height (B) of the lower communicating hole of the at least one partition wall is approximately 2 to 4 mm, and the height (D) from the bottom of the tank to the upper end is approximately 2 to 7 mm. According to the invention, less bubbles pass the lower communicating hole together with the ink, bubbles are more securely separated, the lower communicating hole never interrupts the flow of ink, no ink film is formed in the lower communicating hole when ink is initially filled, the level of each ink chamber more promptly becomes even and ink is supplied to the print head smoothly under a set pressure.

Further, in the ink feeder according to the invention for supplying ink from the main ink tank to the print head via the ink subtank that includes ink chambers, the ink subtank has a casing that stores ink, and a partition wall that partitions the casing and forms multiple ink chambers. The partition wall has an upper communicating part which allows the movement of air in an upper part of the ink chamber, and a lower communicating part which allows the movement of ink in a lower part of the ink chamber. An air communicating hole is provided in one of ink chambers that is formed by the partition wall. An ink quantity detecting device is provided in the ink chamber in which the air communicating hole is formed.

According to the invention, since the air communicating hole is formed in the ink chamber for detecting ink, the level of ink changes as ink is consumed even if an ink film is formed in the upper communicating part. Therefore, the state of consumption of ink is detected by the ink quantity detecting device, ink never overflows due to the excessive supply of ink, ink never runs low independent of the state of another ink chamber and ink is supplied to the print head. In other words, when an ink film is formed in the upper communicating part, the ink chamber for detecting ink functions as a single ink chamber and ink is supplied to the print head under a predetermined pressure.

Also, in the invention, the upper communicating part is a communicating hole. According to the invention, since the ink quantity detecting device is provided in the ink chamber that is provided with the air communicating hole, though the upper communicating part is a communicating hole in which an ink film is readily formed, a state in which ink is consumed is detected by detecting the change of state of the ink in the ink chamber, ink never overflows due to the excessive supply of ink, ink never runs low and ink is supplied to the print head.

Also, in the invention, the ink outlet that ejects ink to the print head is formed in the ink chamber in which the air communicating hole is formed. According to the invention, since the air communicating hole is provided in the ink chamber, in which the ink output for ejecting ink to the print head is formed, and the quantity of ink in the ink chamber is detected, the change of the level of ink ejected from the ink outlet in the ink chamber is secured independent of the state of another ink chamber, the supply to the ink subtank can be controlled and ink is smoothly supplied to the print head.

Also, in the invention, multiple partition walls are provided between the ink supply port and the ink outlet. The width (C) of the lower communicating hole of the partition wall on the side of the ink supply port is approximately 3 to 8 mm, and the length (E) from the center of the lower communicating hole to the ink supply port is equivalent to approximately 50% or more of the whole length (F) of the tank, and the width (C) of the lower communicating hole of the partition wall on the side of the ink outlet is approximately 3 to 8 mm, and the length (E) from the center of the lower communicating hole to the ink outlet is equivalent to approximately 50% or more of the whole length (F) of the tank. According to the invention, when ink meanders through multiple partition walls, a large quantity of bubbles never pass the lower communicating hole of each partition plate, bubbles are more securely separated, each lower communicating hole never interrupts the flow of ink, no ink film is formed in the lower communicating hole when ink is initially filled, the level of each ink chamber promptly becomes even and ink is smoothly supplied to the print head under a set pressure.

Also, in the invention, the print head includes multiple jetting apertures that jet ink on a recording medium. An ink housing that distributes ink to the multiple jetting apertures is connected to the print head. One end of the ink housing is connected to the ink outlet of the ink subtank, and the other end is connected to a second ink supply port of the ink subtank. A circulating path of ink is formed by the ink housing and the ink subtank and the second ink supply port. The lower communicating hole of the partition wall and the ink outlet are arranged so that they are not aligned. According to the invention, since not only the bubbles of ink supplied from the main ink tank to the ink subtank are separated as described above, but ink is circulated between the ink subtank and the ink housing of the print head, bubbles accumulating in a passage between the ink subtank and the print head are collected in the ink subtank. As ink meanders as described above, bubbles in ink are separated by buoyancy, are prevented from flowing into the print head and the print head continues to satisfactorily jet ink.

Also, in the invention, the width (C) of the lower communicating hole of the partition wall is approximately 3 to 8 mm, and the length (E) from the center of the lower communicating hole to the second ink supply port or the ink outlet is equivalent to approximately 50% or more of the whole length (F) of the tank. According to the invention, in the circulated ink, a large quantity of bubbles never pass the lower communicating hole, bubbles are more securely separated, the lower communicating hole never interrupts the flow of ink, no ink film is formed in the lower communicating hole when ink is initially filled, the level of each ink chamber promptly becomes even and ink is smoothly supplied to the print head under a set pressure.

BRIEF DESCRIPTION OF THE DRAWINGS

Preferred embodiments of the invention will be described in detail with reference to the following figures wherein.

DETAILED DESCRIPTION OF THE PREFERRED EMBODIMENTS

Figure 1:
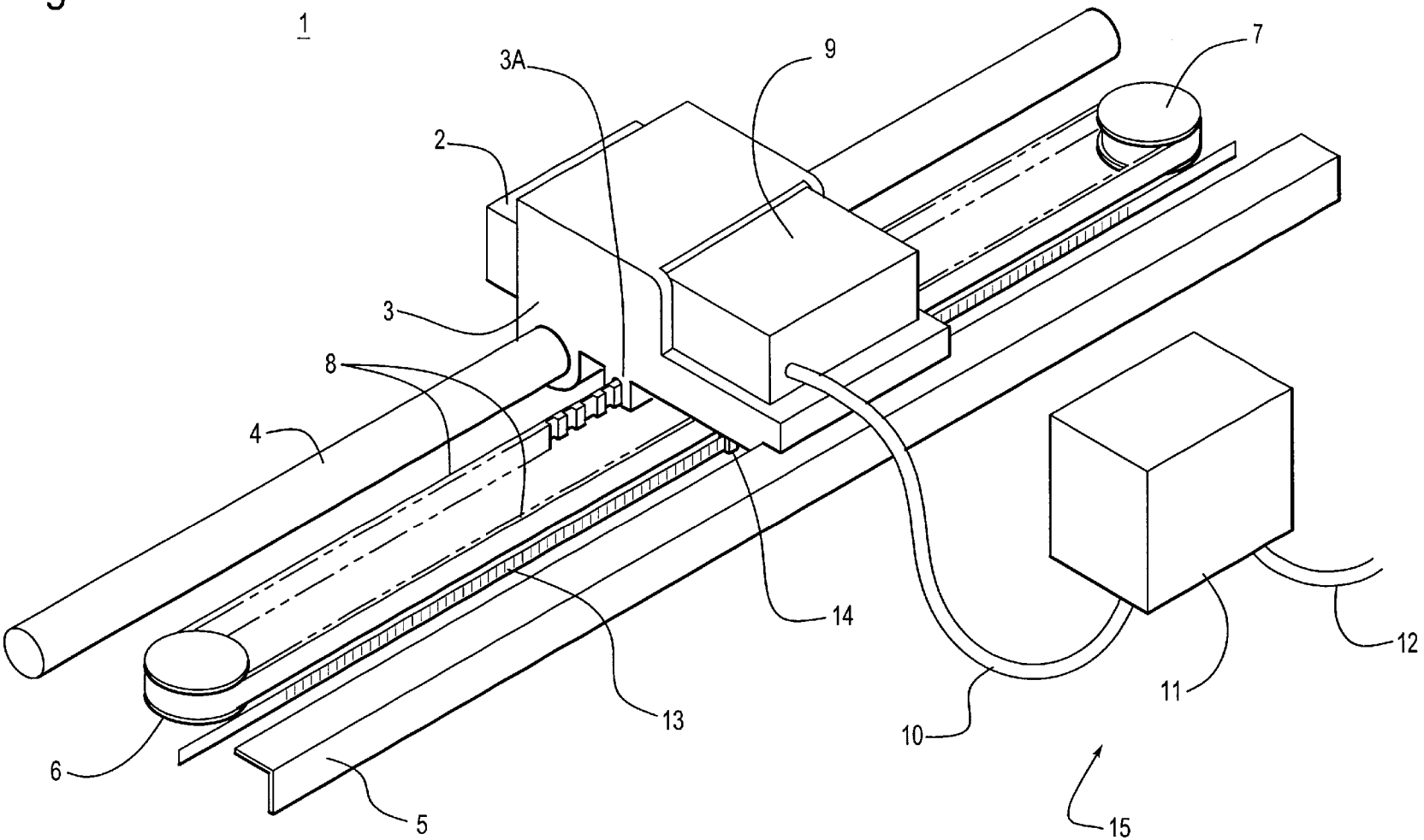
FIG. 1 is a perspective view showing the schematic structure of an ink-jet recording device that uses an ink feeder according to the invention.

Referring to the drawings, embodiments of the invention will be described below.

Figure 2:
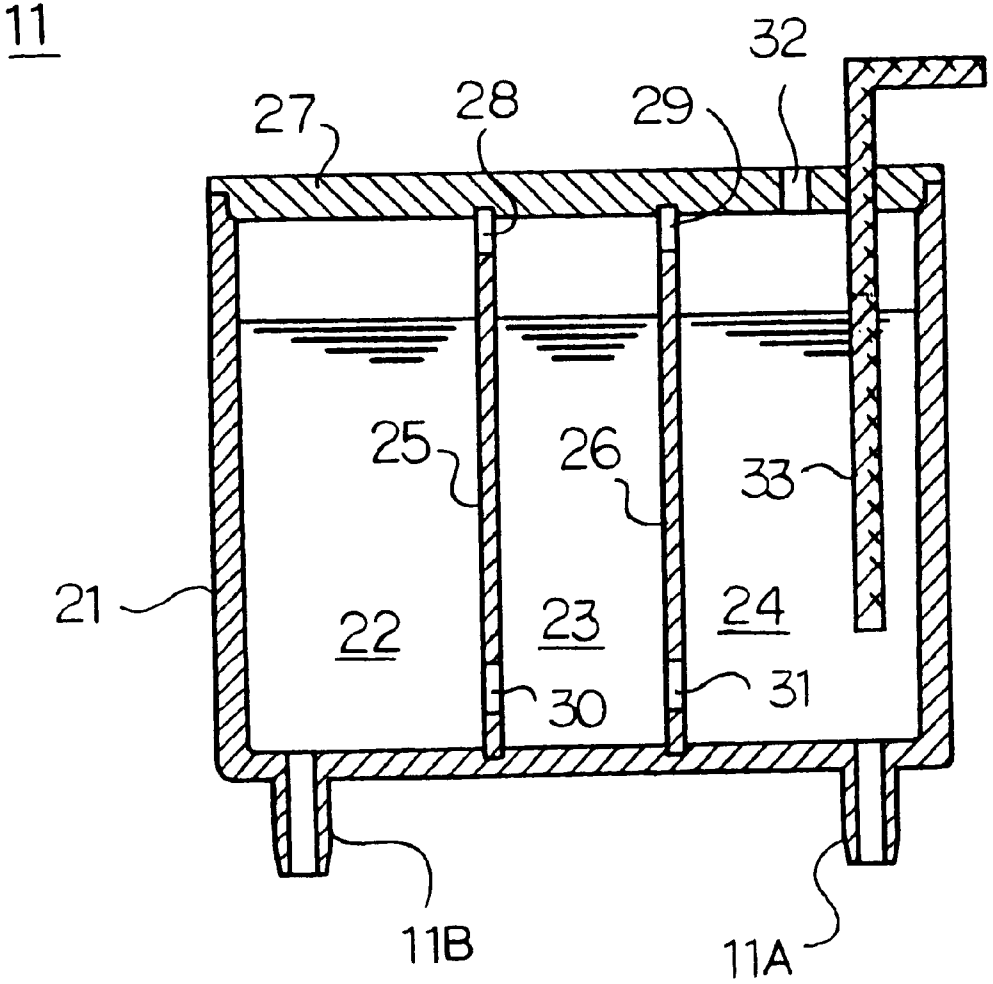
FIG. 2 is a longitudinal sectional view showing an ink subtank of the ink feeder according to the invention.

FIG. 1 is a perspective view showing the schematic structure of an ink-jet recording device according to the invention, and FIG. 2 is a longitudinal sectional view showing an ink subtank of an ink feeder.

As shown in FIG. 1, in an ink-jet recording device 1, a carriage 3, that mounts a print head 2, is supported by a guide rod 4 and a guide bar 5, that are respectively provided in parallel so that the carriage can be moved. A timing belt 8 is wound between a pair of pulleys 6 and 7 so that the timing belt can be moved, and the carriage 3 is fixed to the timing belt 8 via an installation part 3A. When the timing belt 8 is driven by a driving motor (not shown), the carriage 3 (the print head 2) is reciprocated in a printing area for printing on a recording medium.

An ink housing 9 that houses ink is connected to the carriage 3. Ink housed in the ink housing 9 is distributed to multiple jetting apertures of the print head 2, and jetted on a recording medium from each jetting aperture. The ink housing 9 is connected to an ink outlet 11A of an ink subtank 11 via an ink supply pipe 10. An ink supply port 11B of the ink subtank 11 is linked to a main ink tank (not shown) via another ink supply pipe 12. Therefore, ink stored in the main ink tank is supplied from the main ink tank into the ink subtank 11 through the ink supply pipe 12 and the ink supply port 11B via a delivery device, such as a pump (not shown). The ink is supplied from the ink subtank 11 to the ink housing 9 through the ink outlet 11A and the ink supply pipe 10. Then, the ink is supplied from the ink housing 9 to the print head 2. The ink subtank 11 is installed in a stationary position away from the carriage 3 so that the level of ink inside the ink subtank is lower than the each jetting aperture of the print head 2, and a predetermined negative pressure is applied to each jetting aperture by a pressure head. An ink feeder 15 that supplies ink to the print head 2 is formed as described above.

A position detecting device includes a linear encoder 13 that is provided along a direction in which the carriage 3 is moved. Black vertical stripes are formed on a transparent polyethylene terephthalate (PET) film, and a photosensor 14, such as a transparent type photointerrupter, is provided to detect every position of the carriage 3 based upon the quantity of vertical stripes scanned. Specifically, the position of the carriage 3 is determined by counting the vertical stripes of the linear encoder 13 that is scanned by the photosensor 14. A controller that includes a microcomputer and other devices receives a signal from the position detecting device, and generates printing timing based upon the signal, to control the driving of the print head 2 and the carriage 3 and other device.

As shown in FIG. 2 in detail, the ink subtank 11 includes a casing 21 that has an upper opening that stores ink, first and second partition walls 25 and 26 that form first to third ink chambers 22 to 24 by partitioning the casing 21, and a cover 27 that closes the upper opening of the casing 21. The partition walls 25 and 26 are respectively provided with first and second upper communicating parts 28 and 29 which allow the movement of air, such as an interval, in respective upper parts of the ink chambers. The partition walls 25 and 26 are also respectively provided with first and second lower communicating holes 30 and 31, which allow the movement of ink in the respective lower parts of the ink chambers. The ink supply port 11B, the lower communicating holes 30 and 31 of the partition walls 25 and 26 and the ink outlet 11A are arranged so that they are not aligned.

Figure 3:
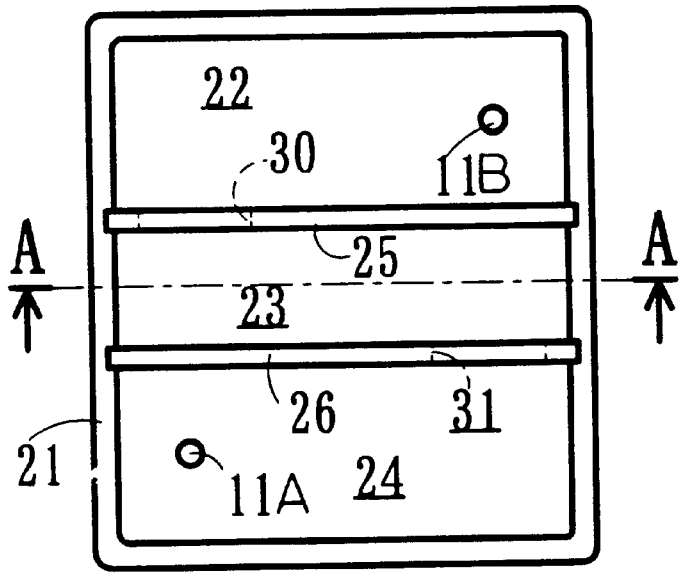
FIG. 3 is a plan view showing a state in which the cover of the ink subtank according to the invention is removed.

When viewed from the top, as shown in FIG. 3, the ink supply port 11B and the ink outlet 11A are formed at the corners of the bottom of the casing 21, and the lower communicating hole 30 is formed at the end of the partition wall 25 close to the side of the ink subtank on the reverse side to the corner of the bottom. The lower communicating hole 31 is formed at the end of the partition wall 26 close to the side of the ink subtank on the reverse side to the lower communicating hole 30 of the partition wall 25 and the ink outlet 11A. Therefore, ink supplied from the ink supply port 11B meanders along the bottom of the ink subtank 11 through each ink chamber 22 to 24, so that ink reciprocates between both walls, and is supplied to the print head 2 via the ink outlet 11A. Bubbles in ink can be moved upward by buoyancy and separated because the ink meanders. The upper communicating parts 28 and 29 are formed so that they are always located higher than the level of ink to allow the movement of air among the ink chambers 22 to 24.

The ink chamber into which the ink supply port 11B opens is the first ink chamber 22, the ink chamber into which the ink outlet 11A opens is the third ink chamber 24 and the ink chamber between both ink chambers is the second ink chamber 23. An air communicating hole 32 for opening the third ink chamber 24 to the environment is provided in a portion of the cover 27 opposite to the third ink chamber 24, and upper space of each ink chamber 22 to 24 communicates with the environment via the upper communicating parts 28 and 29.

An ink sensor 33 that operates as an ink quantity detecting device detects the quantity of ink in the ink subtank 11 is also provided. The ink sensor 33 may include an electrode that is inserted into the ink chamber. Alternatively, the ink sensor 33 may also be an optical device that is provided opposite to the ink chamber.

The ink sensor 33 is connected to a delivery device, such as a pump, that is provided to the ink supply pipe 12 between the ink subtank 11 and the main ink tank. When the ink sensor 33 detects that the amount of ink in the ink subtank 11 is decreasing as ink is jetted in the print head, the delivery device, such as a pump, is driven and ink is supplied from the main tank (not shown).

Figure 4:
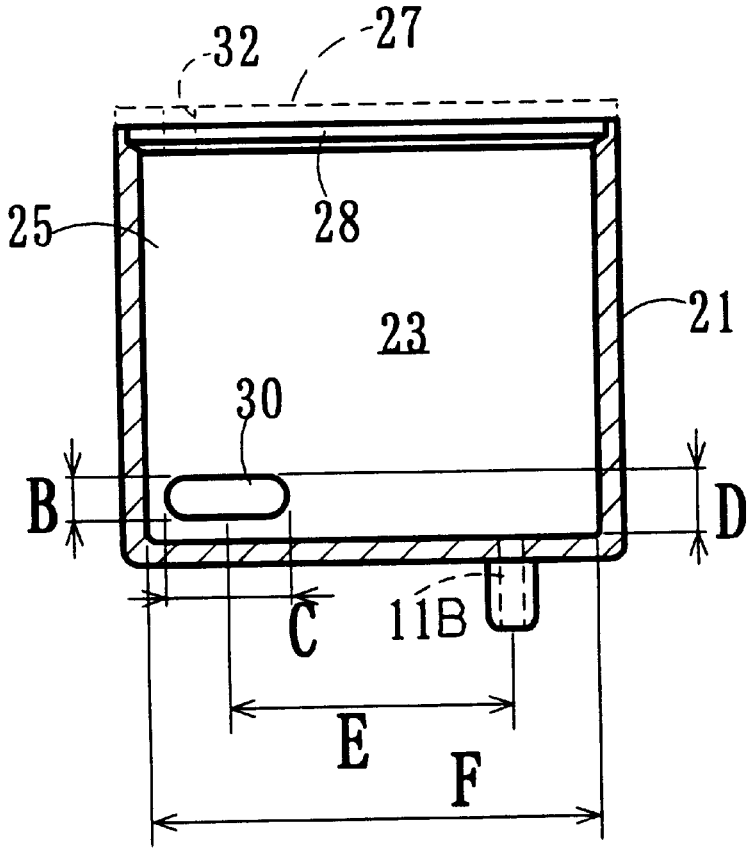
FIG. 4 is a sectional view taken along plane A—A of FIG. 3.

As shown in FIGS. 3 and 4 in detail, the height (B) of the lower communicating hole 30 of the first partition wall 25 on the side of the ink supply port 11B is 2 to 4 mm, the height (D) of the upper end of the lower communicating hole 30 from the bottom of the tank is 2 to 7 mm, the width (C) of the lower communicating hole 30 is 3 to 8 mm and is equivalent to 50% or less of the length (E) from the center of the lower communicating hole 30 to the ink supply port 11B. The length (E) is equivalent to 50% or more of the entire length (F) of the tank. The height (B) of the lower communicating hole 31 of the second partition wall 26 on the side of the ink outlet 11A is 2 to 4 mm, the height (D) of the upper end of the lower communicating hole 30 from the bottom of the tank is 2 to 7 mm, the width (C) of the lower communicating hole 30 is 3 to 8 mm and is equivalent to 50% or less of the length (E) from the center of the lower communicating hole 31 to the ink outlet 11A. The length (E) is equivalent to 50% or more of the entire length (F) of the tank.

A test performed to determine the position and the size of the lower communicating holes 30 and 31 of the first and second partition walls 25 and 26, as described above, will be described below.

TABLE 1

| | | |
|---|---|---|
| B | 1 mm | Ink film is formed and level of each ink chamber hardly becomes even |
| | 2 to 4 mm | OK |
| | 5 mm | Bubbles readily pass (depending upon height of D) |

TABLE 1-continued

| | | |
|---|---|---|
| C | 2 mm | Ink film is formed and level of each ink chamber hardly becomes even |
| | 3 to 8 mm | OK |
| | 9 mm | Bubbles readily pass |
| D | 1 mm | Ink film is formed and level of each ink chamber hardly becomes even |
| | 2 to 7 mm | OK |
| | 8 mm | Bubbles readily pass |
| E | Shorter than 50% of F | Bubbles readily pass |
| | 50% or more of F | OK |

The results of the above test show that if the height (B) of the lower communicating holes 30 and 31 is approximately 1 mm, an ink film is formed in the lower communicating holes 30 and 31 when the ink subtank is initially filled with ink, and not much ink flows into adjacent ink chambers 23 and 24. When ink is consumed during printing, not much ink flows via the lower communicating holes 30 and 31, and the level of each ink chamber 22 to 24 hardly becomes even. It is verified that if the height (B) of the lower communicating holes is approximately 5 mm, bubbles readily pass as ink flows though the height (D). This shows that it is desirable that the range of the height (B) is 2 to 4 mm. It is further desirable that the range is 2.5 to 3.5 mm.

The test shows that if the width (C) of the lower communicating holes 30 and 31 is approximately 2 mm, as in the case of the height (B), an ink film is formed in the lower communicating holes 30 and 31 when the ink subtank is initially filled with ink, not much ink flows into the adjacent ink chambers 23 and 24. The test also shows that when ink is consumed during printing, not much ink flows through the lower communicating holes 30 and 31, and the level of each ink chamber 22 to 24 hardly becomes even. Further, if the width of the lower communicating holes 30 and 31 is approximately 9 mm, bubbles readily pass as ink flows. The test shows that it is desirable that the range of the height C is 3 to 8 mm. The test further shows that the desirable range is 3 to 5 mm.

Further, the test shows that if the height (D) of each upper end of the lower communicating holes 30 and 31 from the bottom of the tank is approximately 1 mm, as in the case of the height (B) and the width (C), an ink film is formed in the lower communicating holes 30 and 31 when the ink subtank is initially filled with ink, and not much ink flows into the adjacent ink chambers 23 and 24. The test shows that when ink is consumed during printing, not much ink flows through the lower communicating holes 30 and 31, and the level of each ink chamber 22 to 24 hardly becomes even. If the above height (D) is approximately 8 mm, bubbles readily pass as ink flows. The test shows that it is desirable that the range of the height (D) is 2 to 7 mm. The test further shows that the desirable range is 2 to 4 mm.

The test shows that if the length (E) from each center of the lower communicating holes 30 and 31 to the ink outlet 11A is shorter than 50% of the whole length (F) of the tank, the distance in which ink meanders is reduced, bubbles are hardly separated by buoyancy and readily pass the lower communicating holes 30 and 31. The tests shows that it is desirable that the length (E) is 50% or more of the whole length (F) of the tank. The test further shows that the desirable range is 70% or more.

The separation of bubbles in ink is accelerated by the structure described above, and ink hardly including bubbles can be supplied to the print head. When the ink subtank is initially filled with ink, an ink film is hardly formed in the lower communicating holes 30 and 31, each ink chamber 22 to 24 can be promptly filled with ink and printing can be promptly started. Further, ink smoothly flows through the lower communicating holes 30 and 31 pursuant to the consumption of ink, and the level of each ink chamber 22 to 24 promptly becomes even. As a result ink sensor 33 effectively controls the level of ink, ink is promptly supplemented from the main ink tank to the ink subtank 11, the level in the ink subtank 11 is kept approximately fixed, ink is supplied to the print head under a set pressure and high printing quality can be maintained.

Since the air communicating hole 32 is provided in the third ink chamber 24 in accordance with the ink feeder having the structure as described above, the level of ink securely changes as ink is consumed. Since the ink sensor 33 is provided in a third ink chamber 24, the quantity of ink is securely detected independent of the state of the other ink chambers 22 and 23, and since ink is supplied from the main ink tank to the ink subtank 11 based upon this detection, ink is securely supplied to the print head 2 via the ink outlet 11A without causing problems, such as overflow of ink through the air communication hole 32 and a shortage of ink.

That is, if an ink film is formed in the upper communicating parts 28 and 29, the first and second ink chambers 22 and 23 become a closed space, and the level is unchanged. However, since the third ink chamber 24 functions as a single ink chamber and the level changes as ink is consumed, the overflow of ink due to the excessive supply of ink and the shortage of ink are avoided by detecting the amount of ink in the third ink chamber 24 by the ink sensor 33 and controlling the supply of ink by the delivery device, such as a pump. Ink can therefore always be supplied to the print head under a predetermined pressure.

In the above embodiment, the first and second upper communicating parts 28 and 29 are respectively defined by a clearance that is formed between the upper end of the first and second partition walls 25 and 26 and the lower surface of the cover 27. However, the invention is not limited to such a structure, and the first and second upper communicating holes may also be an oval or a rectangular communicating hole, for example, instead of the clearance.

Since the ink sensor 33 is provided in the third ink chamber 24 that has the air communicating hole 32, even if the upper communicating parts 28 and 29 are defined by a through hole that is formed by piercing each upper end of the partition walls 25 and 26 and an ink film is readily formed, ink is securely supplied to the print head 2 independent of whether or not an ink film is formed, as described above.

Figure 5:
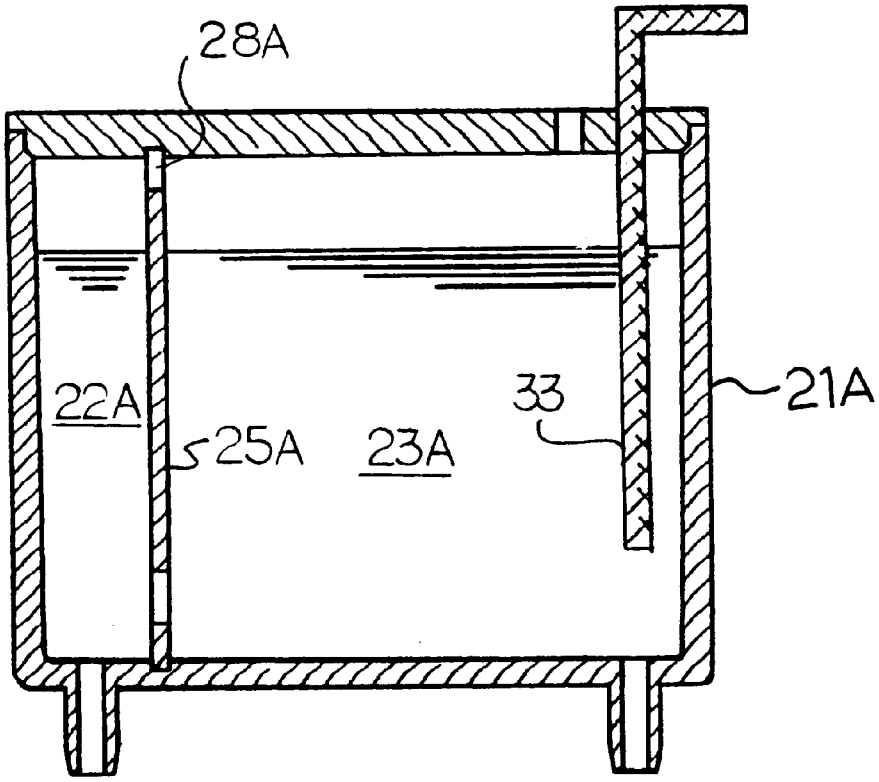
FIG. 5 is a sectional view showing an ink subtank in accordance with another embodiment of the invention.

In the above embodiment, the three ink chambers 22 to 24 are partitioned by the first and second partition walls 25 and 26. However, the invention is not limited to this structure. For example, as shown in FIG. 5, the invention can also be similarly applied to a structure, wherein a casing 21A is partitioned into two ink chambers 22A and 23A by one partition wall 25A. In this structure, it is desirable that the volume of the ink chamber 23A in which the ink sensor 33 is provided is larger than the volume of the other ink chamber 22A, so that the quantity of ink which can be supplied to the print head can be stored in large quantity in the ink subtank, if an ink film is formed in an upper communicating part 28A and the ink chamber 22A becomes a closed space.

The structure may also include three or more partition walls.

The above first and second lower communicating holes 30 and 31 are oval. However, if the lower communicating holes are rectangular, an ink film is hardly formed.

Figure 6:
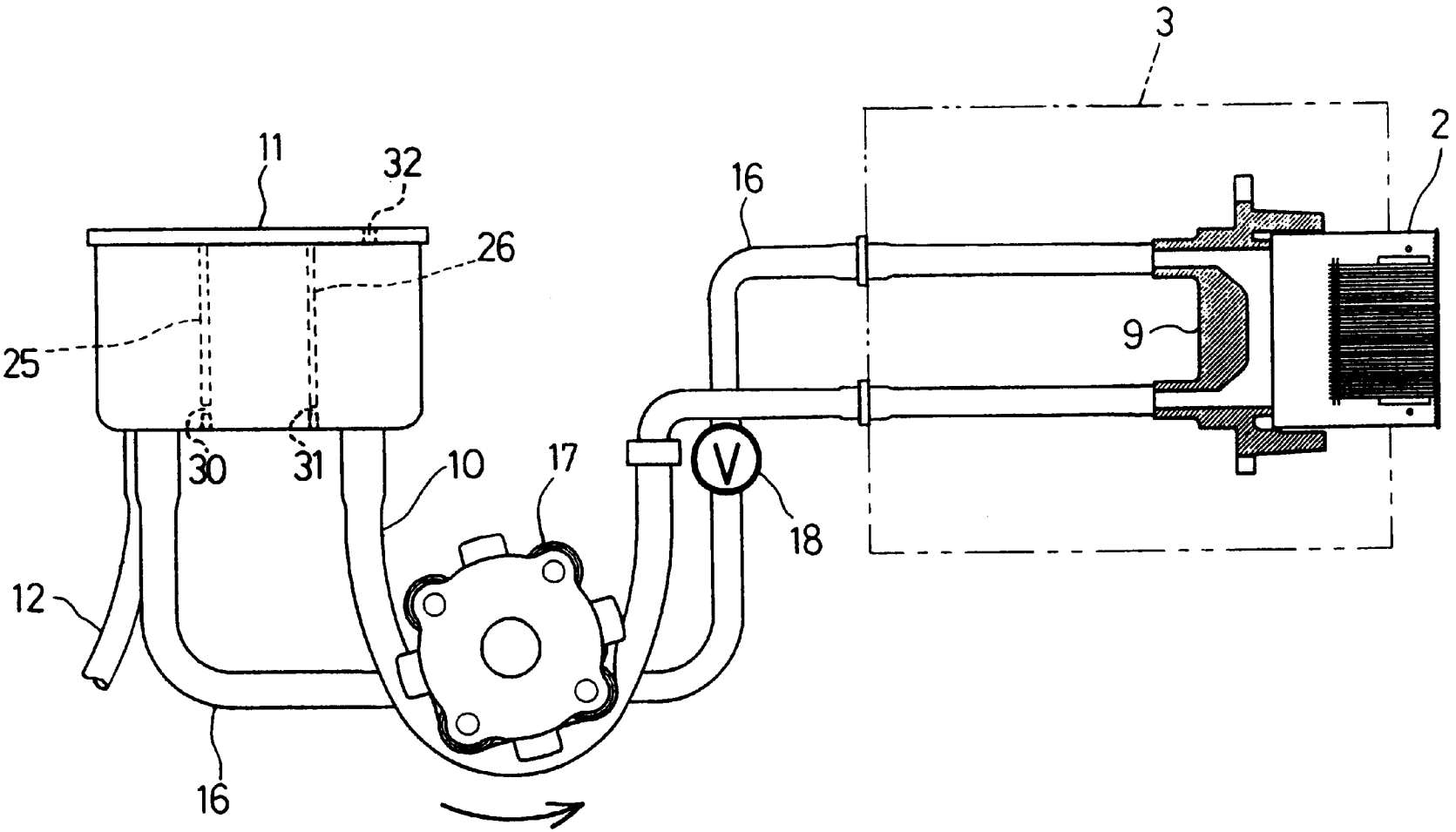
FIG. 6 is a schematic showing an ink passage between the ink subtank, in accordance with another embodiment of the invention, and a print head.
Figure 7:
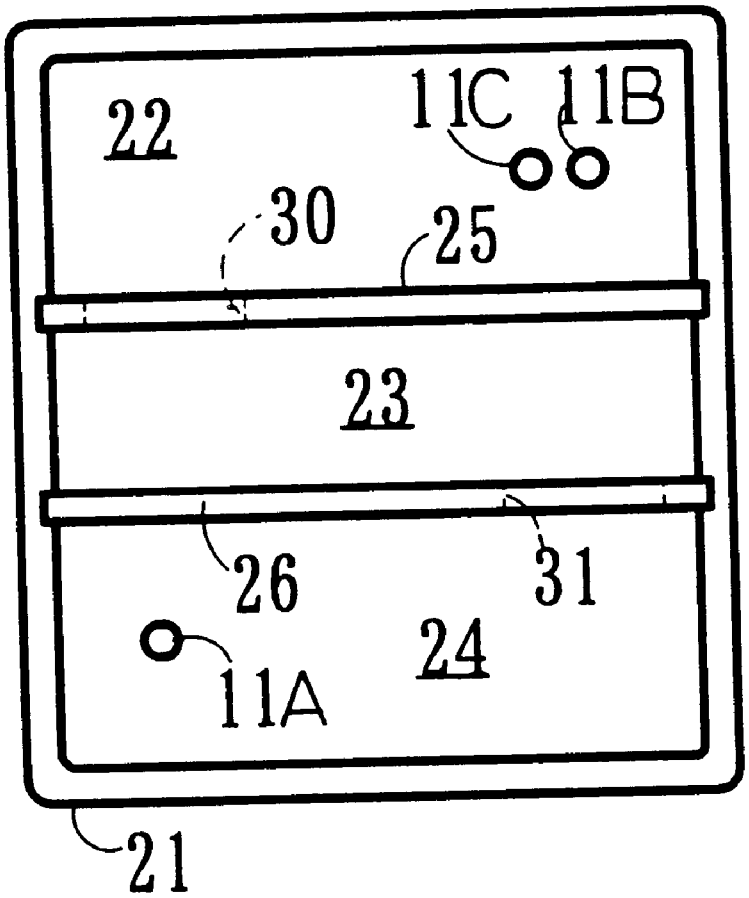
FIG. 7 is a plan view showing a state in which the cover of the ink subtank, shown in FIG. 6, is removed.
Figure 8:
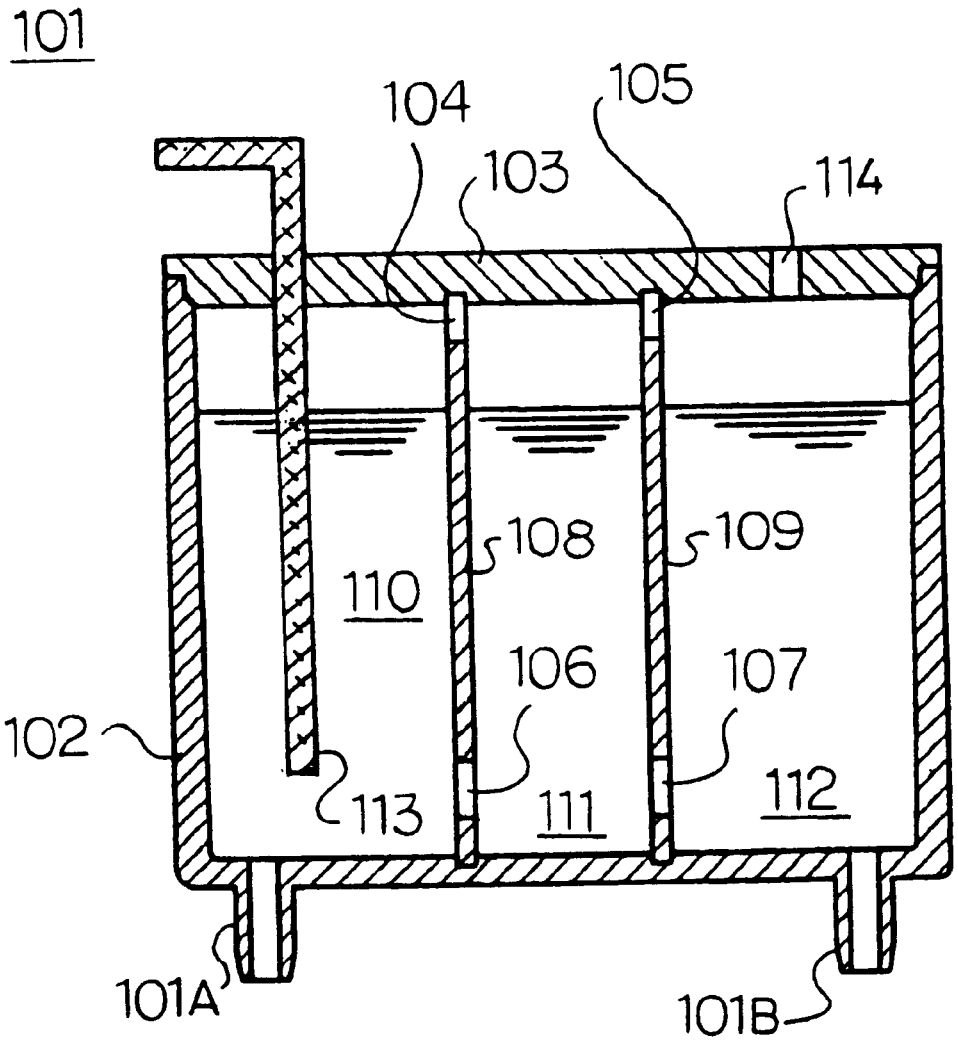
Fig.8 RELATED ART
FIG. 8 is a longitudinal sectional view showing a related art ink subtank of an ink feeder.
Figure 9:
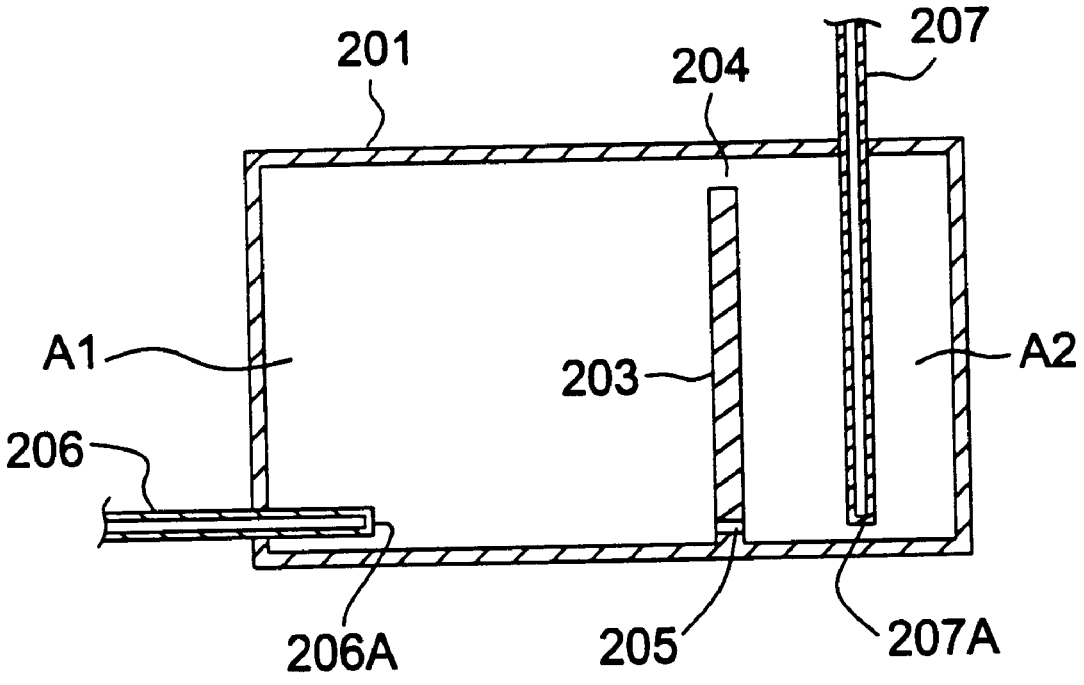
Fig. 9 PRIOR ART
FIG. 9 is a longitudinal sectional view showing a conventional ink subtank of an ink feeder.
Figure 10:
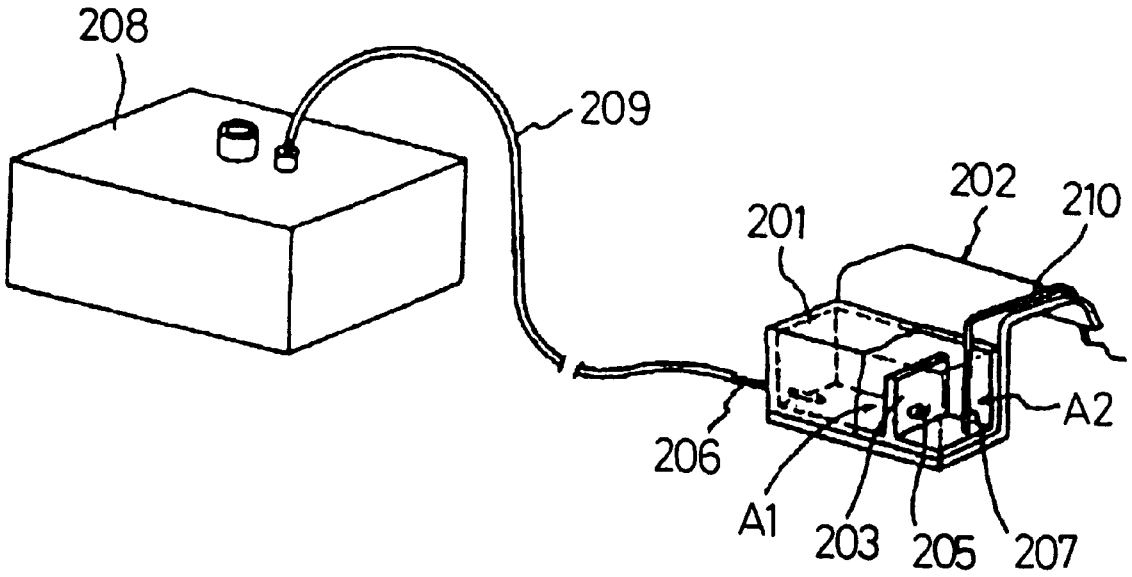
Fig.10 PRIOR ART
FIG. 10 is a perspective view showing the schematic structure f a conventional ink feeder.

FIGS. 6 and 7 show another embodiment of the invention. The same reference numbers are allocated to the same parts as in the above embodiment, and thus the description thereof is omitted. This embodiment is different from the above embodiment in that an ink passage, which returns from an ink housing 9 to an ink subtank 11, is added. That is, an ink supply pipe 10 connected to an ink outlet 11A of the ink subtank 11 is connected to one end of the ink housing 9, and the other end of the ink housing 9 is connected to a second ink supply port 11C, which opens in the bottom of the ink subtank 11 and which is adjacent to the ink supply port 11B, via an ink return pipe 16.

The position of the second ink supply port 11C is set in relationship between the width (C) of a lower communicating hole 30 and the entire length (F) of the tank, as in relationship among the above length (E) in the above embodiment, the width (C) of the lower communicating hole 30 and the entire length (F) of the tank, if the length from the center of the lower communicating hole 30 to the second ink supply port 11C is E2. That is, the width (C) is 50% or less of the length (E2), and the length (E2) is 50% or more of the entire length (F). The other features of the ink subtank 11, and dimensional relationships, are the same as those in the above embodiment.

A delivery device 17, such as a pump, is provided to the ink supply pipe 10. Ink is filled in the ink housing 9 by forming the ink supply pipe 10 of an elastic tube, for example, and moving multiple rollers in a direction in which ink is delivered (in a direction shown by an arrow in FIG. 6), squashing the tube. While ink is filled, superfluous ink is returned to the ink subtank 11 via the ink return pipe 16.

During printing, the delivery device 17 is stopped. However, since the multiple rollers do not completely squash the tube, a passage from the ink subtank 11 to the ink housing 9 is secured. A valve 18, that is provided to the ink return pipe 16, is closed. Therefore, ink is not circulated during printing. However, as ink is consumed in the print head 2, ink is supplied from the ink subtank 11 to the print head via the ink supply pipe 10 and the ink housing 9.

As described in the above embodiment, bubbles in ink supplied to the print head 2 are removed in the ink subtank 11 as much as possible. However, a few bubbles flow into the ink supply pipe 10 and the ink housing 9, and are accumulated inside. When the bubbles flow inside the print head 2, they may prevent the print head from jetting.

To remove the accumulated ink, the valve 18 is released and the delivery device 17 is driven. Thus, ink is forcedly circulated in a circulating path, formed of the ink subtank 11, the ink supply pipe 10, the ink housing 9, the ink return pipe 16 and the ink subtank 11, under pressure. Bubbles accumulated in the circulating path are collected in the ink subtank 11 together with ink. Bubbles rise and are separated because ink meanders in the ink subtank 11, as in the above embodiment. As a result, bubbles in the ink supply pipe 10 and the ink housing 9 are removed.

What is claimed is:

1. An ink jet printer, comprising:

a main tank that stores ink an ink subtank having a casing that stores the ink, the casing including a first ink supply port, a second ink supply port, an ink outlet port and at least one ink partition wall that partitions the casing to form multiple chambers, the at least one partition wall having an upper communicating part which allows air to move in an upper part of the multiple ink chambers, and a lower communicating hole which allows ink to move in a lower part of the multiple ink chambers;

a print head having multiple apertures that jet the ink on a recording medium and an ink housing that distributes the ink to the multiple apertures, the ink housing including one connector and another connector;

a first supply part that connects the main tank to the first supply port to feed the ink from the main tank to the ink subtank;

a second supply part that connects the ink outlet with the one connector to feed the ink from the ink subtank to the print head; and a return part that connects the another connector with the second supply port to feed the ink from the printhead to the ink subtank;

wherein the first ink supply port, the lower communicating hole and the ink outlet are arranged so as not to be aligned and formed so that ink meanders in the ink subtank.

2. The ink feeder according to claim 1, wherein said ink supply port and said ink outlet open at a bottom of said ink subtank.

3. The ink feeder according to claim 2, wherein said ink supply port and said ink outlet are located closely to corners defined at the bottom of said ink subtank; and the lower communicating hole of said at least one partition wall is located close to a side of said ink subtank on the reverse side to the corner of said bottom of the ink subtank.

4. The ink feeder according to claim 3, wherein said at least one partition wall includes multiple partition walls that are disposed between said ink supply port and said ink outlet; and the lower communicating holes of adjacent partition walls of the multiple partition walls are disposed close to opposite sides of said ink subtank.

5. The ink feeder according to claim 1, wherein a width of said lower communicating hole is in a range of 3 to 8 mm.

6. The ink feeder according to claim 5, wherein a width of said lower communicating hole is no longer than 50% of a length from a center of the lower communicating hole to at least one of the ink supply port and the ink outlet.

7. The ink feeder according to claim 1, wherein a length from a center of said lower communicating hole to at least one of the ink supply port and the ink outlet is at least 50% as long as an entire length of the ink subtank.

8. The ink feeder according to claim 1, wherein a height of said lower communicating hole is in a range of 2 to 4 mm.

9. The ink feeder according to claim 1, wherein a height from an inner bottom surface of said ink subtank to an upper end of said lower communicating hole is in a range of 2 to 7 mm.

10. The ink feeder according to claim 1, wherein a width of the lower communicating hole of said at least one partition wall is approximately 3 to 8 mm; and a length from a center of the lower communicating hole to at least one of the ink supply port and the ink outlet is at least 50% as long as an entire length of the ink subtank.

11. The ink feeder according to claim 10, wherein a height of the lower communicating hole of said at least one partition wall is approximately 2 to 4 mm; and a height from a bottom surface of the ink subtank to an upper end of the lower communicating hole is approximately 2 to 7 mm.

12. The ink feeder according to claim 1, wherein said at least one partition wall includes multiple partition walls that are disposed between said ink supply port and said ink outlet;

a width of the lower communicating hole of the at least one partition wall on the side of said ink supply port is approximately 3 to 8 mm;

a length from a center of the lower communicating hole to the ink supply port is at least 50% as long as an entire length of the ink subtank;

a width of the lower communicating hole of the at least one partition wall on the side of said ink outlet is approximately 3 to 8 mm; and a length from the center of the lower communicating hole to the ink outlet is at least 50% as long as an entire length of the ink subtank.

13. The ink feeder according to claim 1, wherein a width of the lower communicating hole of said at least one partition wall is approximately 3 to 8 mm; and a length from a center of the lower communicating hole to at least one of said second ink supply port and said ink outlet is at least 50% of an entire length of the ink subtank.

14. The ink feeder according to claim 1, further comprising an ink quantity detector that detects a quantity of ink in said ink subtank.

15. The ink feeder according to claim 1, further comprising an air communicating hole that opens one of the ink chambers that are formed by said at least one partition wall to an exterior environment.

16. The ink feeder according to claim 15, wherein the ink quantity detector is disposed in the ink chamber in which said air communicating hole is formed.

17. The ink feeder according to claim 15, wherein the ink outlet that supplies ink to the print head is formed in the ink chamber in which said air communicating hole is formed.

18. The ink feeder according to claim 1, wherein said upper communicating part is formed so that the upper communicating part is higher than a level of ink stored in the casing to allow air to move between ink chambers.

19. The ink feeder according to claim 1, wherein said upper communicating part is a communicating hole.

20. A method of printing, comprising the steps of:

storing ink in a main tank;

storing the ink in a casing of an ink subtank, the casing including a first ink supply port, a second ink supply port, an ink outlet port and at least one ink partition wall that partitions the casing to form multiple chambers, the at least one partition wall having an upper communicating part which allows air to move in an upper part of the multiple ink chambers, and a lower communicating hole which allows ink to move in a lower part of the multiple ink chamber;

jetting the ink on a recording medium with multiple apertures of a print head;

distributing the ink to the multiple apertures with an ink housing, the ink housing including one connector and another connector;

feeding the ink from the main tank to the ink subtank with a first supply part that connects the main tank to the first supply port;

feeding the ink from the ink subtank to the print head with a second supply part that connects the ink outlet with the one connector;

feeding the ink from the print head to the ink subtank with a return part that connects the another connector with the second supply port;

arranging the first ink supply port, the lower communicating hole and the ink outlet so as not to be aligned so that the ink meanders in the ink subtank.

21. An ink feeder for supplying ink from a main tank to a print head, comprising:

a first ink supply part that supplies the ink from the main tank;

a second ink supply part that supplies the ink to the print head; and an ink subtank that supplies the ink to the print head via the second ink supply part, the ink subtank receiving the ink from the main tank via the first ink supply part, the ink subtank including:

an ink supply port that receives the ink from the main tank;

an ink outlet that supplies the ink to the print head;

a casing that stores the ink, the casing including one wall and an opposite wall; and at least two partition walls that partition the casing to form multiple ink chambers, the at least two partition walls each having an upper communicating part which allows air to move in an upper part of the multiple ink chambers, and a lower communicating hole which allows the ink to move in a lower part of the multiple ink chambers;

wherein the ink supply port is disposed adjacent the opposite wall of the casing, the lower communicating hole of one of the at least two partition walls is disposed closest to the ink supply port and adjacent the one wall of the casing, the ink outlet is disposed adjacent the one wall of the casing, and the lower communicating hole of another of the at least two partition walls is disposed closest to the ink outlet and adjacent the opposite wall of the casing so that the ink meanders in the ink subtank.

22. An ink subtank that receives ink from a main tank via a first ink supply part, and supplies ink to a print head via a second ink supply part, the ink subtank comprising:

an ink supply port that receives the ink from the main tank;

an ink outlet that supplies the ink to the print head;

a casing that stores the ink, the casing including one wall and an opposite wall; and at least two partition walls that partition the casing to form multiple ink chambers, the at least two partition walls each having an upper communicating part which allows air to move in an upper part of the multiple ink chambers, and a lower communicating hole which allows the ink to move in a lower part of the multiple ink chambers; wherein the ink supply port is disposed adjacent the opposite wall of the casing, the lower communicating hole of one of the at least two partition walls is disposed closest to the ink supply port and adjacent the one wall of the casing, the ink outlet is disposed adjacent the one wall of the casing, and the lower communicating hole of another of the at least two partition walls is disposed closest to the ink outlet and adjacent the opposite wall of the casing so that the ink meanders in the ink subtank.

23. A method of printing, comprising the steps of:

storing ink in a main tank;

storing the ink in a casing of an ink subtank, the casing including one wall and an opposite wall, a first ink supply port, a second ink supply port, an ink outlet port and at least two ink partition walls that partition the casing to form multiple chambers, the least two partition walls having an upper communicating part which allows air to move in an upper part of the multiple ink chambers, and a lower communicating hole which allows the ink to move in a lower part of the multiple ink chambers, one of the at least two partition walls having a lower communicating hole adjacent the one wall of the casing, and another of the at least two partition walls having a lower communicating hole adjacent the opposite wall of the casing so that the ink meanders in the ink subtank;

jetting the ink on a recording medium with multiple apertures of a print head;

distributing the ink to the multiple apertures with an ink housing of the print head, the ink housing including one connector and another connector;

feeding the ink from the main tank to the ink subtank with a first supply part that connects the main tank to the first supply port;

feeding the ink from the ink subtank to the print head with a second supply part that connects the ink outlet with the one connector;

feeding the ink from the print head to the ink subtank with a return part that connects the another connector with the second supply port.

24. An ink jet printer, comprising:

an ink subtank having a casing that stores the ink, the casing including an ink supply port, an ink outlet port and at least one ink partition wall that partitions the casing to form multiple chambers, the at least one partition wall having an upper communicating part which allows air to move in an upper part of the multiple ink chambers, and a lower communicating hole which allows ink to move in a lower part of the multiple ink chamber;

a print head having multiple apertures that jet the ink on a recording medium and an ink housing that distributes the ink to the multiple apertures, the ink housing including one connector and another connector;

a supply part that connects the ink outlet port with the one connector to feed the ink from the ink subtank to the printhead; and a return part that connects the another connector with the ink supply port to feed the ink from the printhead to the ink subtank;

wherein the first ink supply port, the lower communicating hole and the ink outlet are arranged so as not to be aligned and formed so that ink meanders in the ink subtank.

25. An ink jet printer, comprising:

a main tank that stores ink;

an ink subtank having a casing that stores the ink, the casing including an ink supply port, an ink outlet port and at least one ink partition wall that partitions the casing to form multiple chambers, the at least one partition wall having an upper communicating part which allows air to move in an upper part of the multiple ink chambers, and a lower communicating hole which allows ink to move in a lower part of the multiple ink chambers;

a print head having multiple apertures that jet the ink on a recording medium and an ink housing that distributes the ink to the multiple apertures, the ink housing including one connector and another connector;

a first supply part that connects the main tank to the supply port to feed the ink from the main tank to the ink subtank;

a second supply part that connects the ink outlet with the one connector to feed the ink from the ink subtank to the printhead; and a return part that connects the another connector with the supply port to feed the ink from the printhead to the ink subtank;

wherein the ink supply port, the lower communicating hole and the ink outlet are arranged so as not to be aligned and formed so that ink meanders in the ink subtank.

* * * * *